United States Patent [19]

Evans et al.

[11] Patent Number: 4,841,955

[45] Date of Patent: Jun. 27, 1989

[54] CHIROPRACTIC ADJUSTOR

[75] Inventors: Joseph M. Evans, Export; E. Rex Moore, Pittsburgh, both of Pa.

[73] Assignee: Kinetic Technology, Inc., Greensburg, Pa.

[21] Appl. No.: 237,651

[22] Filed: Aug. 29, 1988

Related U.S. Application Data

[63] Continuation of Ser. No. 52,412, May 21, 1987, abandoned.

[51] Int. Cl.[4] ..... A61H 7/00

[52] U.S. Cl. ..... 128/52; 128/55

[58] Field of Search ..... 128/51–55, 128/45, 46, 60, 34–36, 59, 44

[56] References Cited

U.S. PATENT DOCUMENTS

| | | | |
|---|---|---|---|
| 2,078,159 | 4/1937 | Redding | 128/54 |
| 4,088,128 | 5/1978 | Mabuchi | 128/52 |
| 4,116,235 | 9/1978 | Fuhr et al. | 128/69 |
| 4,549,535 | 10/1985 | Wing | 128/55 |
| 4,566,442 | 1/1986 | Mabuchi et al. | 128/52 |

*Primary Examiner*—Edgar S. Burr
*Assistant Examiner*—Huong Q. Pham
*Attorney, Agent, or Firm*—Fleit, Jacobson, Cohn & Price

[57] ABSTRACT

A chiropractic adjustor for applying an adjustment energy to a patient through a plunger having a resilient or cushioned head with the energy applied to the plunger being supplied by a solenoid assembly capable of producing an adjustable and reproducible energy or force that is transferred from the solenoid to the cushioned plunger thereby providing a chiropractic adjustor that is solenoid operated and capable of providing precisely reproducible energy settings over a wide range and the capability of providing a reproducible energy level and a reproducible contact energy or force between the adjustor and patient.

7 Claims, 1 Drawing Sheet

FIG. 1
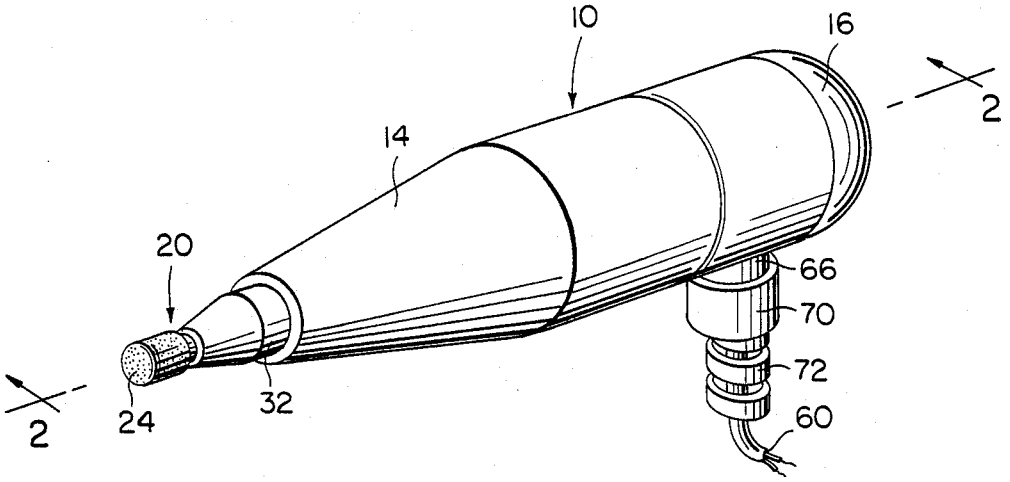
FIG. 2
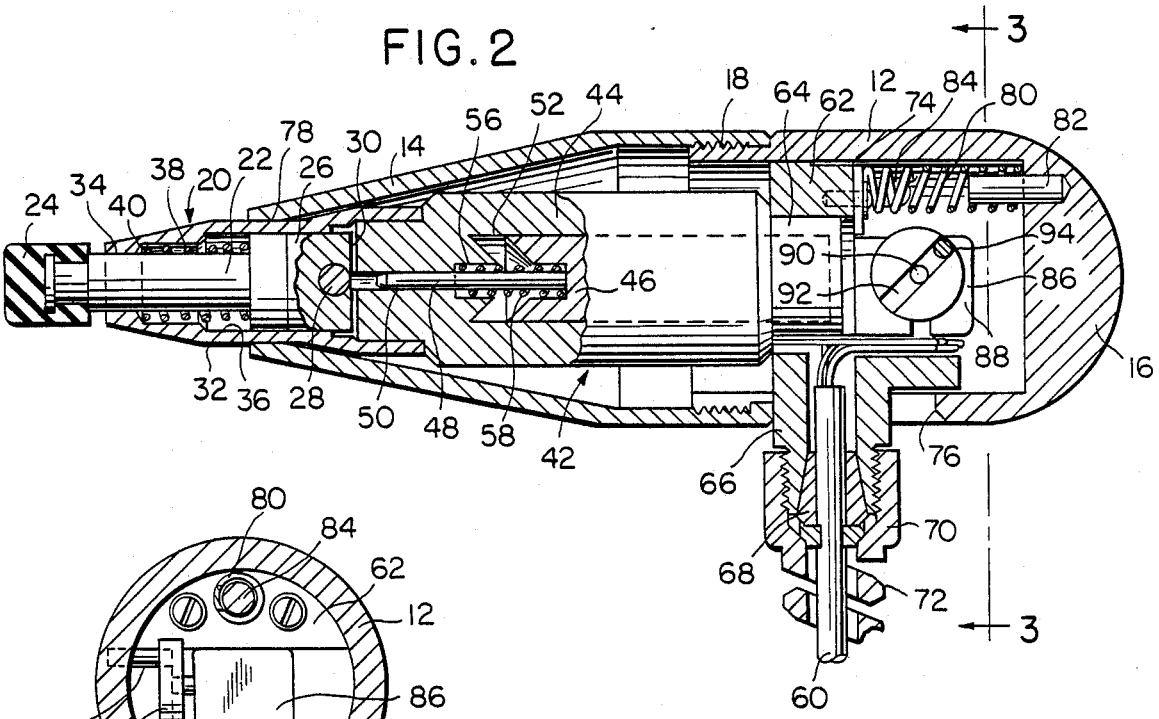
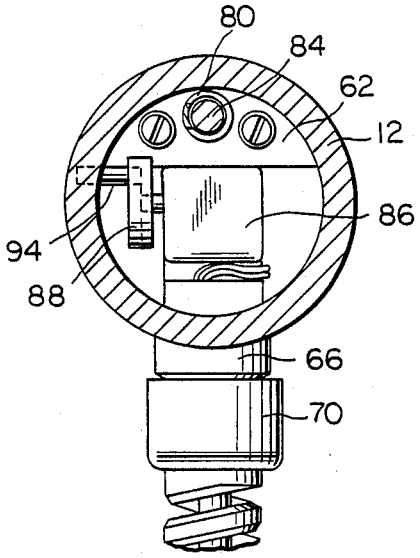
FIG. 3

CHIROPRACTIC ADJUSTOR

This application is a continuation of application Ser. No. 052,412, filed May 21, 1987, now abandoned.

BACKGROUND OF THE INVENTION

Field of the Invention

The present invention generally relates to a chiropractic adjustor for applying an adjustment energy to a patient through a plunger having a resilient or cushioned head with the energy applied to the plunger being supplied by a solenoid assembly capable of producing an adjustable and reproducible energy or force that is transferred from the solenoid to the cushioned plunger thereby providing a chiropractic adjustor that is solenoid operated and capable of providing precisely reproducible energy settings over a wide range and capable of providing a reproducible energy level and a reproducible contact energy or force between the adjustor and patient.

INFORMATION DISCLOSURE STATEMENT

Conventional chiropractic adjustments of the spinal vertebrae involve the application of pressure or force directly to the body by the use of the hands or mechanical devices. U.S. Pat. No. 4,116,235 discloses a mechanical device for this purpose and discusses in some detail the technique of applying force by the application of thumb thrust. The abovementioned patent and conventional chiropractic techniques do not utilize the specific structure of the present invention and are not capable of obtaining the functional benefits derived for the chiropractic adjustor of this invention.

SUMMARY OF THE INVENTION

An object of the present invention is to provide a chiropractic adjustor having a plunger or rod provided with a cushioned head for engagement with a patient with a thrust energy being transferred to the plunger or rod from an electro-magnetic solenoid in which movement of the core of the solenoid is transferred to the plunger or rod in response to energization of the solenoid coil with the energy transmitted to the patient being varied over a wide range and precisely reproducible and also providing a reproducible initial contact energy or force between the adjustor and patient.

Another object of the invention is to provide a chiropractic adjustor in accordance with the preceding object in which the plunger or rod is spring biased to an initial constant position and the core of the solenoid is spring biased to an initial constant position with the energy transferred to the plunger from the core being varied by varying the triggering point for supplying electrical energy to the coil of the solenoid.

A further object of the invention is to provide a chiropractic adjustor in accordance with the preceding objects in which the contact pressure between the chiropractic adjustor and the patient is controlled by a spring mechanism between the operating mechanism of the chiropractic adjustor and the individual operator so that as the chiropractic adjustor is pressed against the patient, the spring mechanism is compressed and the energy or force against the patient increases with the spring compression also functioning to vary the setting of a rotary potentiometer which can be monitored so that the solenoid is triggered when the resistance of the potentiometer matches a preset value thus enabling a reproducible energy or force to be obtained.

Still another object of the invention is to provide a chiropractic adjustor which is effective in applying chiropractic energy to a patient which energy or forces are variable and precisely reproducible with the device being easy to use without the operator becoming unduly fatigued which occurs frequently when manipulating mechanical devices or manually applying thumb thrust to a patient.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the chiropractic adjustor of the present invention.

FIG. 2 is a longitudinal, sectional view taken generally along section 2—2 of the adjustor illustrating the structure and relationship of the components.

FIG. 3 is a sectional view along section line 3—3 on FIG. 2.

DESCRIPTION OF THE PREFERRED EMBODIMENT

The chiropractic adjustor of the present invention is generally designated by reference numeral 10 and includes an elongated, generally cylindrical housing 12 which has a forward end 14 that tapers to form a generally conical configuration for the housing. The other end of the housing 12 is provided with a semi-spherical closed end 16. The housing 12 and the forward end 14 thereof may be separably connected by a screw threaded connection at 18 to provide access into the interior of the housing and to separate the components of the invention for repair, replacement and the like.

A plunger or rod assembly generally referred to as a thrust member and designated by numeral 20 is located at the forward end of the housing 14 and includes a rigid plunger rod 22 of metal or the like having a cushioned head or tip 24 comprising a patient contact member at the outer end thereof which may be in the form of a cylindrical body of cushioning material such as rubber, plastic or the like that encapsulates the outer end of the plunger rod 22. The plunger rod 22 includes an enlarged head 26 on its inner end with the inner end of the head including a ball 28 embedded therein with a portion of the periphery of the ball being exposed through the face 30 of the head. The ball 28 transfers impact to the plunger rod 22 and is in the form of a hardened member or hard insert thus providing a hardened surface for receiving impact forces and transmitting them to the plunger assembly 20.

The plunger assembly 20 is received in a tubular guide tube 32 that encloses the major length portion of the plunger rod 22 and the inner plunger head 26 with the outer end of the guide tube closely surrounding and slidably engaging the plunger rod 22 as at 34. The portion of the guide tube 32 inwardly of the tip end thereof is larger than the plunger rod 22 thus forming an annular space 36 which receives a coil compression spring 38 having one end engaging a shoulder 40 at the inner end of the guide portion 34 of the guide tube 32. The other end of the spring 38 engages the inner head 26 on the plunger rod 22 thus serving to bias the plunger assembly 20 inwardly with respect to the tubular guide tube 32.

Disposed interiorly of the tubular housing is a solenoid assembly generally designated by reference numeral 42 which includes a coil or winding 44 and a core 46 longitudially reciprocally mounted within the coil 44. The core 46 includes an elogated hardened rod or hard extension 48 slidable in a bore 50 in the outer end of the coil 44 so that the tip end of the rod 48 will impact against the hardened ball 28 in the plunger assembly 20 when the core 46 is pulled inwardly into the hollow interior 52 of the coil 44. A compression coil spring 58 is interposed between the core 46 and a portion of the hollow interior 52 of the coil 44 to bias the core 46 longitudinally outwardly of the coil 44 with the force exerted by the spring 58 being only sufficient to move the core outwardly of the coil 44 when the coil 44 is not energized therefore not interfering with the rapid inward movement of the core 46 in relation to the coil 44 when the coil 44 is energized by connection with a source of electrical energy which may be supplied through an electrical cord 60 that may be plugged into a suitable electrical outlet or the like and which extends interiorly of the housing 12 in a manner described in more detail hereinafter.

The inner end of the coil 44 includes an annular member 62 surrounding a reduced cylindrical portion 64 of the solenoid with the annular member including a laterally extending boss 66 which is hollow and receives the electrical cord 60 that is anchored to the boss 66 by a tapered clamping sleeve 68 and compression nut 70 so that tension on the cord 60 will not tension the cord beyond the clamping sleeve 68. The cord 60 is provided with a short spiral protector 72 to avoid sharp bending of the cord 60.

The annular member 62 is slidably received in and engages the interior of the cylindrical housing 12 with the sliding and guiding surfaces being designated by numeral 74 as illustrated in FIG. 2 so that the housing 12 can move in relation to the solenoid 42. The housing 12 includes a longitudinal slot 76 which receives the lateral boss 66 to accommodate relative longitudinal movement of the housing 12 in relation to the solenoid 42 and the plunger assembly 20 and particularly the guide tube 32 which is slidably received in the tip end of the frusto conical housing 14 with the sliding and guiding movement between the guide tube 32 and the tip end of the frusto conical housing 14 being designated at 78. A coil compression spring 80 is interposed between the inner surface of the semi-spherical end 16 of the housing 12 and the opposing surface of the annular member 62 with the spring being received on a dowel pin 82 on the end of the housing and a projecting dowel pin 84 on the annular member 62 thus biasing the annular member 62 away from the semi-spherical end 16 of the housing 12. With this construction, inward pressure may be exerted on the housing 12 when the cushioned head or tip 24 is engaged with a patient so that the spring 80 is compressed as the housing 12 moves inwardly in relation to the solenoid 42 and plunger assembly 20 so that the contact pressure between the chiropractic adjustor and the patient can be precisely controlled.

The electrical energy supplied through the cord 60 is connected with solenoid coil 44 with a potentiometer 86 triggering the solenoid 42. The potentiometer 86 includes a rotatable adjustable wheel or knob 88 comprising a control member connected to a shaft 90 extending outwardly from the potentiometer so that rotation of the wheel 88 will vary the triggering point at which voltage is supplied to the solenoid coil 44. The adjustment wheel 88 is provided with a diametrically extending groove 92 on its outer surface which receives an inwardly extending stationary pin 94 on the housing 12 with the pin 94 being offset from the rotational axis 90 of the wheel 88 as shown in FIGS. 2 and 3 so that when the housing 12 moves longitudinally in relation to the solenoid 42 and the annular member 62 which supports the potentiometer 86, the wheel 88 will be rotated in accordance with the longitudinal movement of the pin 94 which is translated to rotational movement of the shaft 90 due to the pin 94 engaging the slot or groove 92. Thus, as the chiropractic adjustor is pressed against the patient, the spring 80 is compressed and the energy or force against the patient increases. The degree of spring compression caused by inward pressure on the housing 12 is measured and responded to by the slotted wheel 88 being turned by the pin 94 since the wheel 88 will be turned in proportion to the change in the relationship between the housing 12 and the potentiometer 86 that is in fixed relation to the annular member 62, the solenoid 42 and the plunger assembly 20. With this arrangement, the chiropractic adjustor can be triggered when the resistance of the potentiometer 86 which is adjusted by rotation of the wheel 88 matches a preset resistance value thereby automatically energizing the solenoid when a predetermined pressure has been exerted against the patient which causes a predetermined inward movement of the housing in relation to the solenoid 42 and plunger assembly 20 and corresponding compression of the spring 80. With this arrangement, contact pressure for a specific energy setting is known and is reproducible. A suitable monitoring circuit may be provided for measuring the resistance of the potentiometer and triggering the solenoid when the resistance of the potentiometer matches a preset value.

In the construction of the chiropractic adjustor, the mass of the plunger assembly is substantially equal to the mass of the moving core of the solenoid so that the extension 48 on the core will impact on the plunger rod 22 of equal mass for transferring the energy of the moving core to the patient through the cushioned rod. Inasmuch as the solenoid core is initially held outside the solenoid in a fixed position by the light spring 58, the starting position of the core is fixed. Likewise, the cushioned plunger rod 22 is held in a fixed starting position relative to the solenoid by the spring 40 prior to being impacted by the solenoid core. The plunger rod 22 can move in the direction of impact but is held in its initial position by contact pressure between the patient and the chiropractic adjustor. Thus, the initial positions of the solenoid core and the cushioned rod are fixed so that the energy of the system can only be varied by varying the velocity of the solenoid core at the point of impact with the cushioned rod 22. The velocity of the solenoid core can be varied by varying the force with which it is accelerated into the solenoid which is proportional to the current flowing in the coils of the solenoid which in turn is proportional to the voltage applied to the core from a second potentiometer in addition to the triggering potentiometer 86. The triggering point at which solenoid 42 is actuated can be varied by the relative movement of the housing 12 inwardly in relation to the solenoid 42 and plunger rod 22 so that when a preset resistance has been matched in the potentiometer 86 by rotation of wheel 88 and shaft 90, an electrical circuit is completed to the solenoid 42. The second potentiometer (not shown) is electrically connected with the solenoid 42, cord 60 and potentiometer 86 to energize the coil 44 when the potentiometer 86 is triggered. The second potentiometer may be preset or provided with a variable control or resistance means, such as a series of push buttons or a rotary control knob, accessible from the exterior of the housing in order to vary the voltage supplied to the solenoid coil 44 when triggered in order to vary the velocity of the core 46 and thus the energy transmitted to the patient. With this arrangement, the voltage may be precisely measured and regulated and, therefore, the energy available for impact of the cushioned head or tip 24 with the patient is precisely reproducible.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A chiropractic adjustor comprising a hollow housing, a thrust member having a patient contact member at one end thereof mounted in the housing, an electrically energized solenoid having a core mounted in the housing so that the housing is longitudially movable relative to the thrust member and the solenoid, the solenoid being mountec in alignment with the movable thrust member and imparting impact energy thereto when the solenoid is energized thereby imparting an impact energy to the thrust member which transfers the impact energy of the solenoid core to a patient, spring means interposed between the housing and solenoid which is compressed by inward movement of the housing toward a patient, and control means for triggering the solenoid to impart impact energy from the core to the thrust member which is reproducible thereby providing a reproducible transmission of energy to the patient, the control means being responsive to the compression of the spring means which is directly related to pressure between the patient contact member and a patient when the patient contact member is held against the body of a patient, the control means triggering the solenoid when the pressure between the patient contact member and a patient reaches a preset value.

2. The adjustor as defined in claim 1 wherein said control means includes a potentiometer having a control member associated with the housing so that it is adjusted in response to inward movement of the housing toward the patient and triggers the solenoid when the potentiometer resistance reaches a preset value.

3. The adjustor as defined in claim 2 wherein said control member is connected with the housing and varies the potentiometer resistance in response to relative longitudinal movement between the housing and the solenoid.

4. The adjustor as defined in claim 3 wherein said solenoid includes resistance means to control voltage supplied to the solenoid when the potentiometer resistance reaches a preset value.

5. the adjustor as defined in claim 4 wherein the mass of the longitudinally movable thrust member and solenoid core are substantially equal.

6. The adjustor as defined in claim 5 wherein the patient contact member includes a cushioned head and the thrust member and core are maintained in initial positions by spring devices which do not substantially affect the impact energy transferred from the core to the thrust member.

7. The structure as defined in claim 6 wherein said longitudially movable thrust member includes a hard insert facing the core of the solenoid, said core of the solenoid including a hard extension engageable with the hard insert on the thrust member.

* * * * *